United States Patent [19]

Osterhaus

[11] 4,219,986

[45] Sep. 2, 1980

[54] CAPPING APPARATUS

[75] Inventor: Joseph C. Osterhaus, Port Jefferson, N.Y.

[73] Assignee: Perry Industries, Inc., Hicksville, N.Y.

[21] Appl. No.: 2,602

[22] Filed: Jan. 11, 1979

[51] Int. Cl.[2] ..... B65B 7/28; B67B 3/064; B67B 3/18

[52] U.S. Cl. ..... 53/314; 53/334

[58] Field of Search ..... 53/313, 314, 315, 334

[56] References Cited

U.S. PATENT DOCUMENTS

| | | | |
|---|---|---|---|
| 2,481,508 | 9/1949 | Gschwend et al. | 53/315 |
| 2,883,817 | 4/1959 | Foresman, Jr. | 53/334 |
| 3,537,231 | 11/1970 | Dimond | 53/334 X |
| 3,538,672 | 11/1970 | Shields | 53/334 X |
| 3,953,957 | 5/1976 | Brothers et al. | 53/334 X |

*Primary Examiner*—Horace M. Culver

*Attorney, Agent, or Firm*—Senniger, Powers, Leavitt and Roedel

[57] ABSTRACT

Apparatus for applying caps to containers such as glass bottles or vials having a flange at their mouth end and crimping the cap on each container under the flange, in which the containers with caps thereon are gripped at top and bottom in a rotary turret, carried around in a circular path by the turret, spun on their axes as they are carried around by the turret, and the caps are crimped by bringing crimping tools carried by the turret into crimping engagement with the caps.

29 Claims, 17 Drawing Figures

CAPPING APPARATUS

BACKGROUND OF THE INVENTION

This invention relates to capping apparatus, and more particularly to such apparatus for automatically applying caps to containers such as glass bottles or vials.

The invention is especially concerned with apparatus for applying caps to containers such as glass bottles or vials containing pharmaceuticals, the containers having a neck and a flange on the neck, and the caps being sheet metal caps having a cylindrical skirt which is adapted to fit around the flange and to be crimped under the flange for sealing the container. The apparatus is adapted, for example to apply caps of the type sold under the name Flip-Off Seals by The West Company of Phoenixville, Pennsylvania, to glass vials. These caps are sheet metal (aluminum) caps having a sheet metal top and an integral annular skirt depending from the top, with a plastic head on the top of the cap having a stem secured in a central hole in the top of the cap adapted to be "flipped off" for opening the hole. The caps are used for compressing rubber stoppers which are inserted in the mouths of the vials after they have been filled to seal the vials. The rubber stopper has a flange overlying the flange at the mouth end of the vial, and the skirt of the cap surrounds the two flanges and is crimped under the bottom of the flange on the vial to compress the stopper flange down against the mouth end of the vial.

Prior apparatus for applying caps, such as the above-mentioned caps, to vials has generally been either of a type in which the caps are crimped by means of rollers which are rotated around the cap on a vial with the vial and cap stationary, or a type in which the vials with caps thereon are carried around in a circular path in a rotary turret with the caps engaging a fixed circular rail for rotating the vials and crimping the cap. Each of these has the disadvantages that, in some instances, the caps are marred and do not have the so-called pharmaceutical elegance that is desired for pharmaceutical vials. Neither is able readily to accommodate tolerance variations in the caps, e.g., tolerance variations in the diameter of the skirts of the caps, or tolerance variations in the heights of the vials, and thus does not always produce good seals. In the second type, the caps in some instances may even be cut by the rail. Also, the production rate of prior apparatus may not be as high as desired.

SUMMARY OF THE INVENTION

Among the objects of the present invention may be noted the provision of capping apparatus of the class described which is operable at a relatively high rate (e.g., 400–500 containers per minute) to crimp caps on containers with more uniformly effective seals, and with good appearance ("pharmaceutical elegance") for the crimped caps, despite tolerance variations in the caps and containers; and the provision of such apparatus which is readily adapted to handle containers and caps of different sizes.

In general, apparatus of this invention is adapted to supply caps to containers such as glass vials or bottles, the containers being of the type having a neck and a flange on the neck at the mouth end thereof, and the caps being of the type having an annular skirt adapted to surround the flange and to be crimped under the flange. The apparatus comprises endless conveyor means carrying a series of sets of grippers spaced at equal intervals therearound, each set being adapted to grip a container at the top and bottom of the container, the conveyor means being movable to move the sets of grippers through an endless, generally horizontal path with containers held in an upright position, and to carry each set of grippers from a loading station where a container with a cap thereon is delivered to the set through a cap crimping zone for crimping the cap, and thence to an unloading station where the container is unloaded from the set. Means is provided for continuously driving the conveyor means, for delivering a container to a set of grippers as the set travels through the loading station, and for placing a cap on the mouth end of each container prior to its delivery to a set of grippers. Each set of grippers comprises a bottom and a top gripper adapted to grip a container in upright position therebetween, the bottom and top grippers being relatively movable on the endless conveyor means between an open position for delivery of a container with a cap thereon on to the lower gripper and a closed position for gripping the container with the cap thereon, and also being rotatable relative to the conveyor means.

Means is provided for continously rotating the top grippers as the conveyor means carries the sets of grippers through said endless path for rotating the containers and the caps thereon. Means is provided for effecting closing movement of the bottom and top grippers of each set of grippers as it travels away from the loading station, for holding them closed as they travel through said crimping zone, and for opening them as they travel out of the crimping zone to the unloading station. The conveyor means carries a series of cap crimping tools, one for each set of grippers, each of the crimping tools being mounted on the conveyor means for movement from a retracted position spaced from a cap on the container gripped in the respective set of grippers to a crimping position in crimping engagement with the skirt of the cap for crimping the skirt under the flange of the container, and means is provided for moving each crimping tool to its crimping position as the respective set of grippers moves away from the loading station, holding it in crimping position for crimping the cap on the container as the container travels through said cap crimping zone, and then retracting it. The apparatus further comprises means for unloading containers from the sets of grippers at the unloading station.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
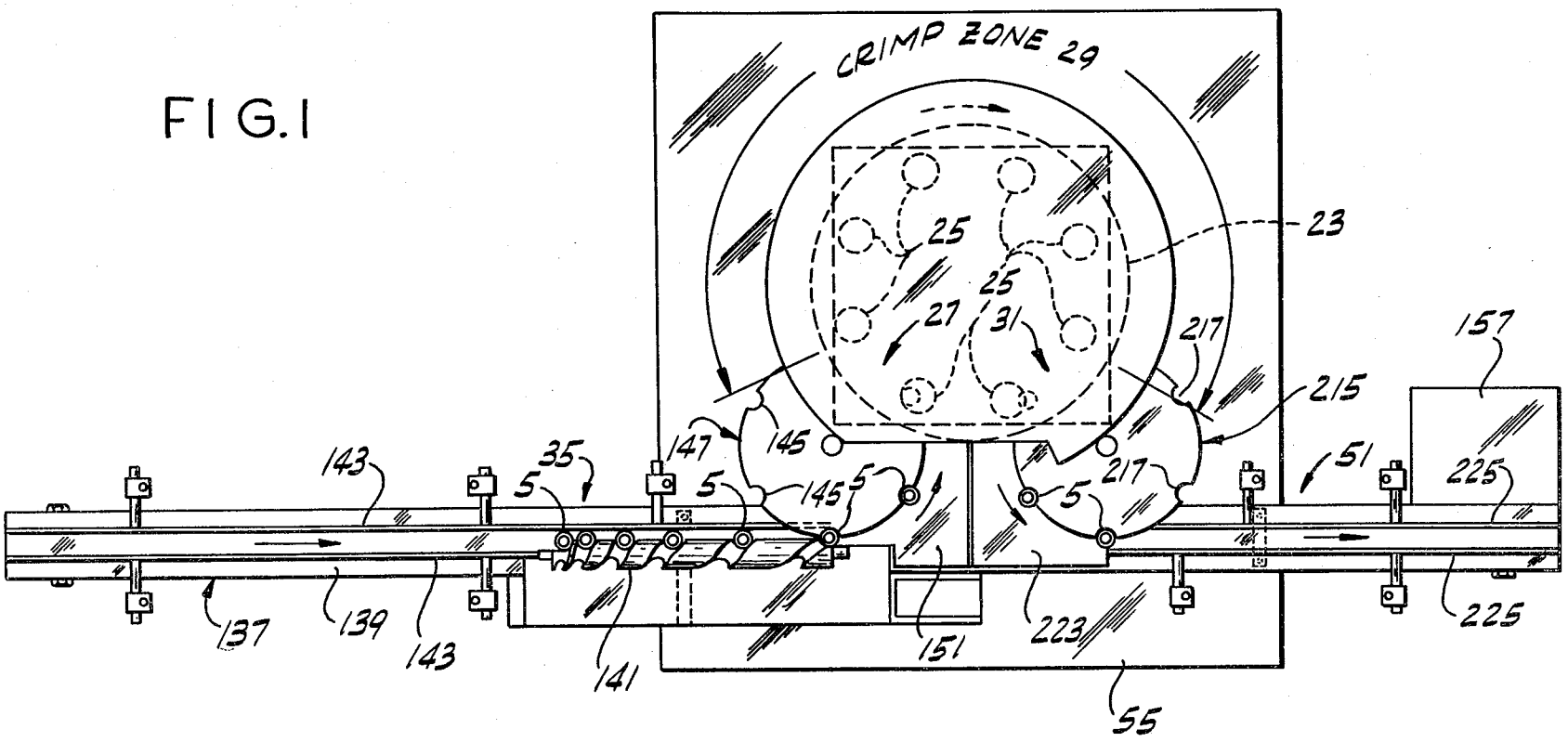
FIG. 1 is a general plan of an apparatus of this invention for capping containers such as glass bottles or vials.
Figure 2:
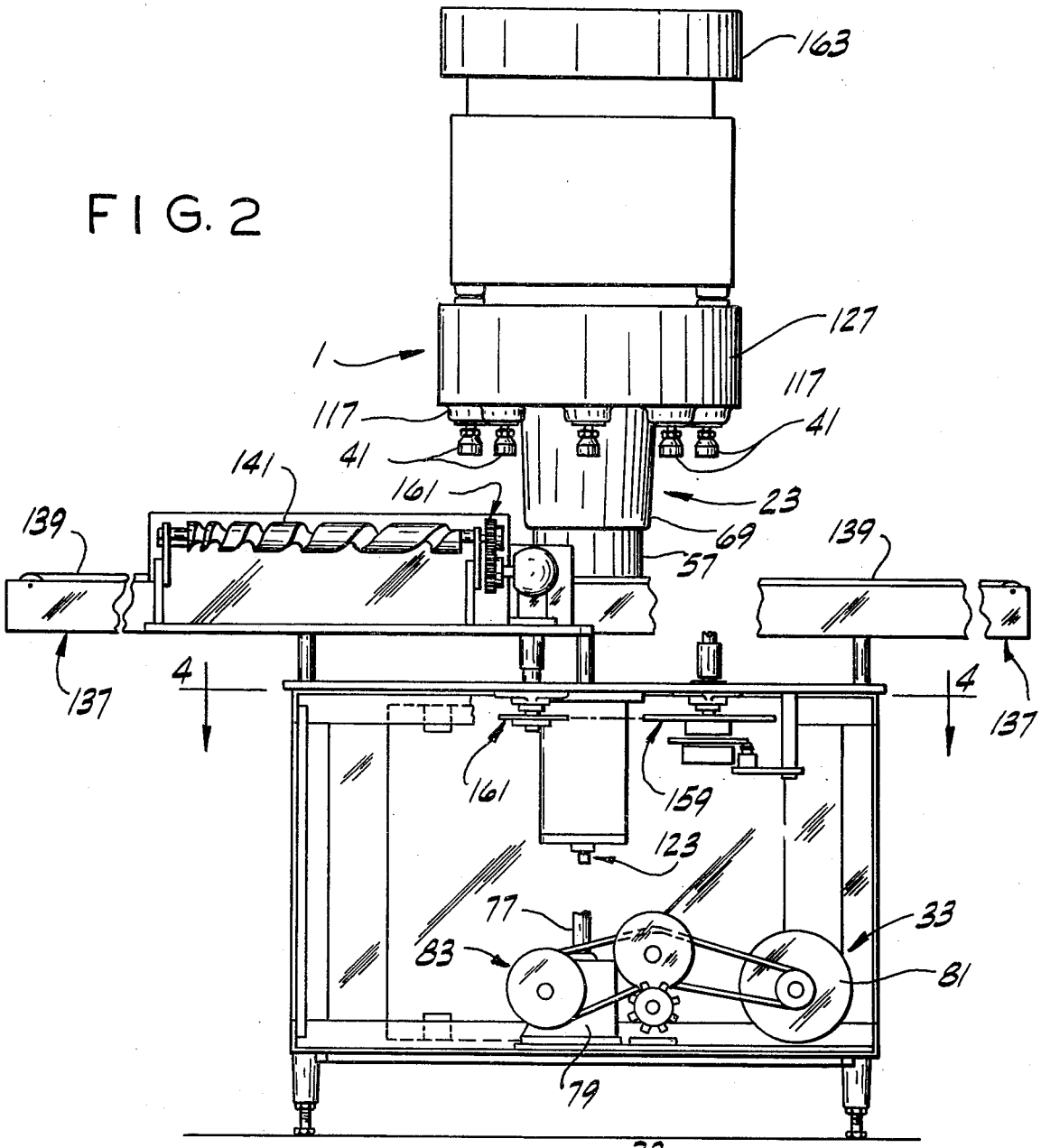
FIG. 2 is a view in elevation of the apparatus, with parts broken away.
Figure 4:
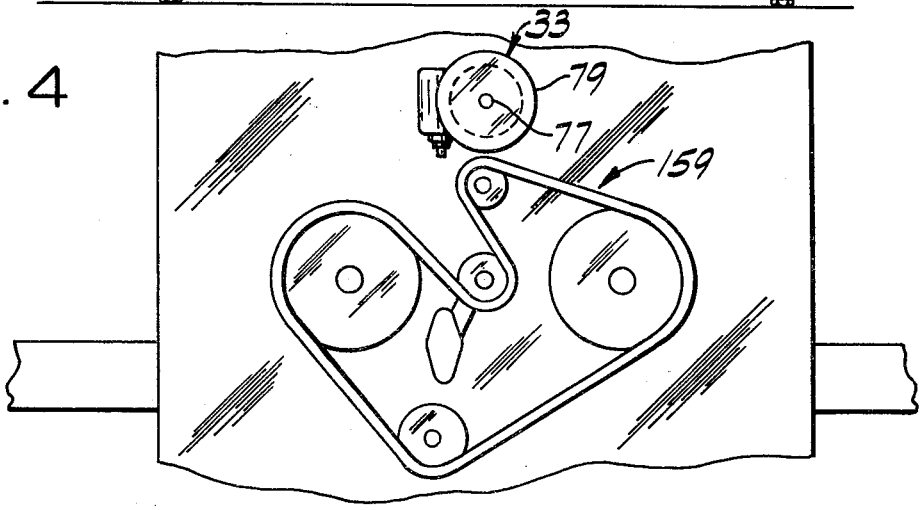
FIG. 4 is a view generally on line 4—4 of FIG. 2 showing certain drive mechanism.
Figure 3:
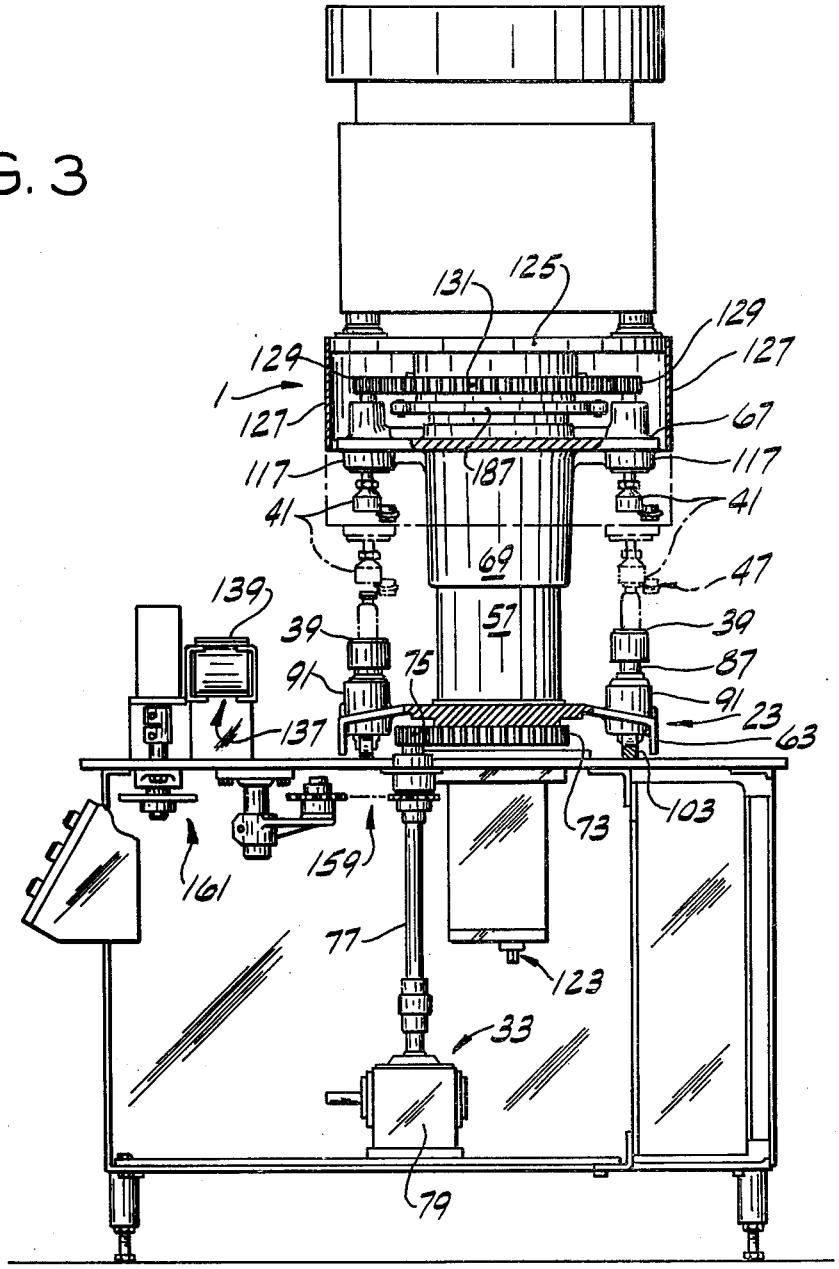
FIG. 3 is a view in elevation of the apparatus as viewed from the right side of FIGS. 1 and 2, with parts broken away and parts shown in section, showing a turret head in solid lines in an upper limit of adjustment and in phantom at a lower position of adjustment.
Figure 11:
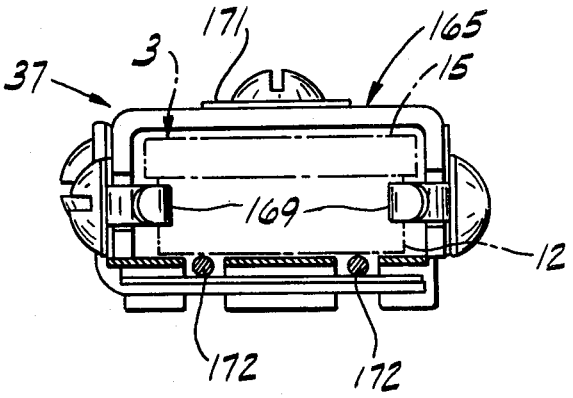
FIG. 11 is an enlarged end view of the lower end of the chute shown in FIG. 10.
Figure 14:
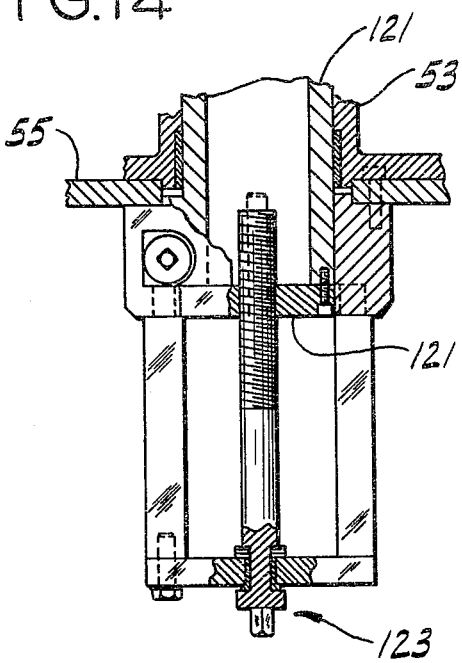
FIG. 14 is a view showing details of a turret adjusting mechanism.
Figure 12:
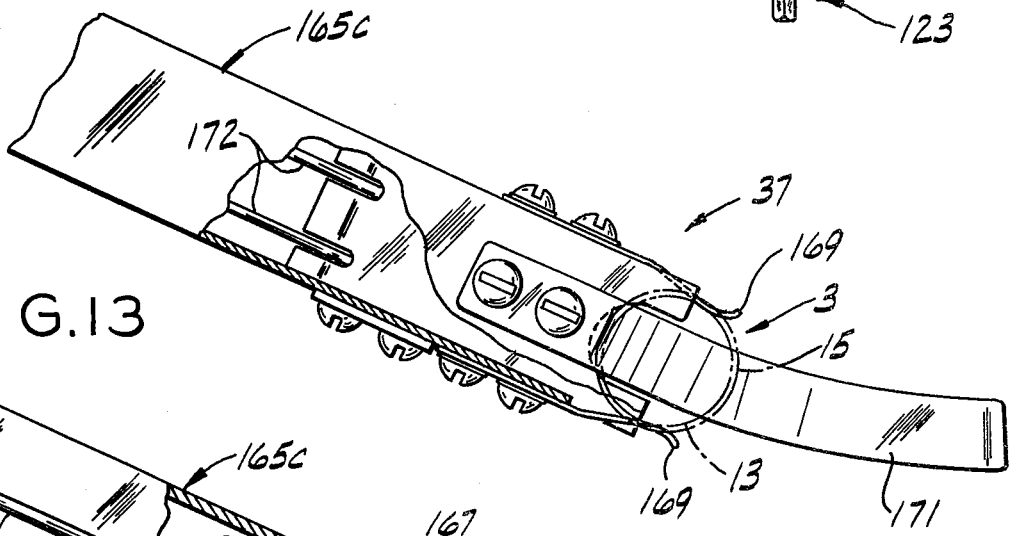
FIG. 12 is an enlarged plan of the lower end of the chute.
Figure 13:
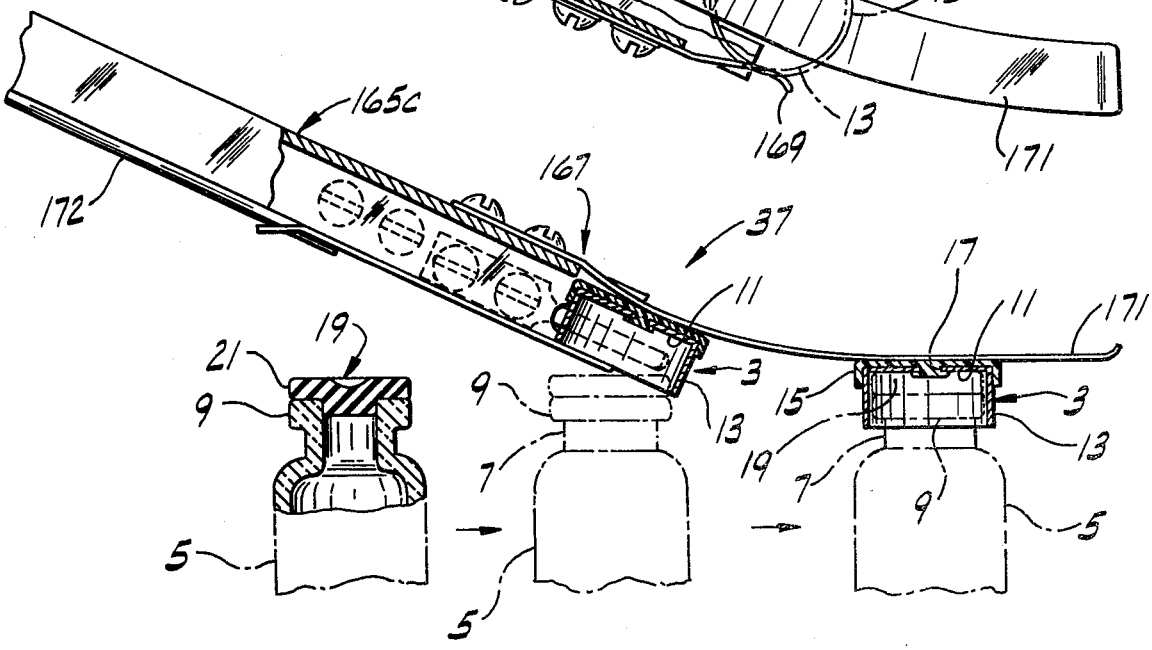
FIG. 13 is an enlarged side elevation of the lower end of the chute, with parts broken away and shown in section, showing how caps are applied to the containers.

Referring to the drawings, there is generally indicated at 1 in FIGS. 1–3 apparatus of this invention for applying caps such as indicated at 3 in FIGS. 11–13 to containers such as indicated at 5 in FIG. 13. The container 5, as shown, in a glass bottle or vial such as is commonly used for holding pharmaceuticals, having a neck 7 and a flange 9 at its mouth end. Such vials come in a wide range of sizes, but a typical vial has an outside body diameter of one inch, an outside neck diameter of about 11/16 inch, and an outside flange diameter of about ¾ inch, with the flange about ⅛ inch high. The cap, as illustrated, is of a well-known type sold under the name Flip-Off Seal as above noted, comprising a circular sheet metal (aluminum) top 11 and an annular (cylindrical) skirt 13 depending from the top, with a plastic head 15 on the top of the cap secured in a central hole 17 in the top of the cap adapted to be "flipped off" for opening the hole. The vials are conventionally closed, after they have been filled, by means of a rubber stopper such as indicated at 19 in FIG. 13 having a flange 21 overlying the mouth end of the vial, this flange being compressed for sealing the vial by placing the cap on the mouth end of the vial with the skirt 13 surrounding the flange 21 of the stopper and the flange 9 of the vial and crimping the lower margin of the skirt under the flange 9.

The apparatus 1 of this invention, which is adapted automatically to apply the caps 3 to the containers (vials) 5, comprises endless conveyor means generally designated 23 carrying a series of sets of grippers each indicated generally at 25, each set being adapted to grip a container 5 at the top and bottom of the container. The conveyor means 23 is movable to move the sets 25 of grippers through an endless horizontal path with containers 5 (stoppered and having caps 3 thereon) gripped in the sets and in upright position, and to carry each set one after another from a loading station 27 (see FIG. 1) where a container 5 with a cap 3 thereon is loaded in the set, thence through a crimping zone 29 where the cap on the container is crimped, and thence to an unloading station 31 where the container is unloaded from the set. The set of grippers is open at the loading station for entry of a container therein, is closed to grip the container and also to rotate the container on its vertical axis as the container travels through the crimping zone, and then is opened for unloading the container, all as will appear. Means indicated generally at 33 (see FIGS. 2, 3 and 5) is provided for continuously driving the conveyor means. At 35 is generally indicated means for delivering a container to a set 25 of grippers as the set travels through the loading station 27, and at 37 (see FIGS. 10–13) is generally indicated means for placing a cap on the mouth end of each container prior to its delivery to a set of grippers.

Figure 5:
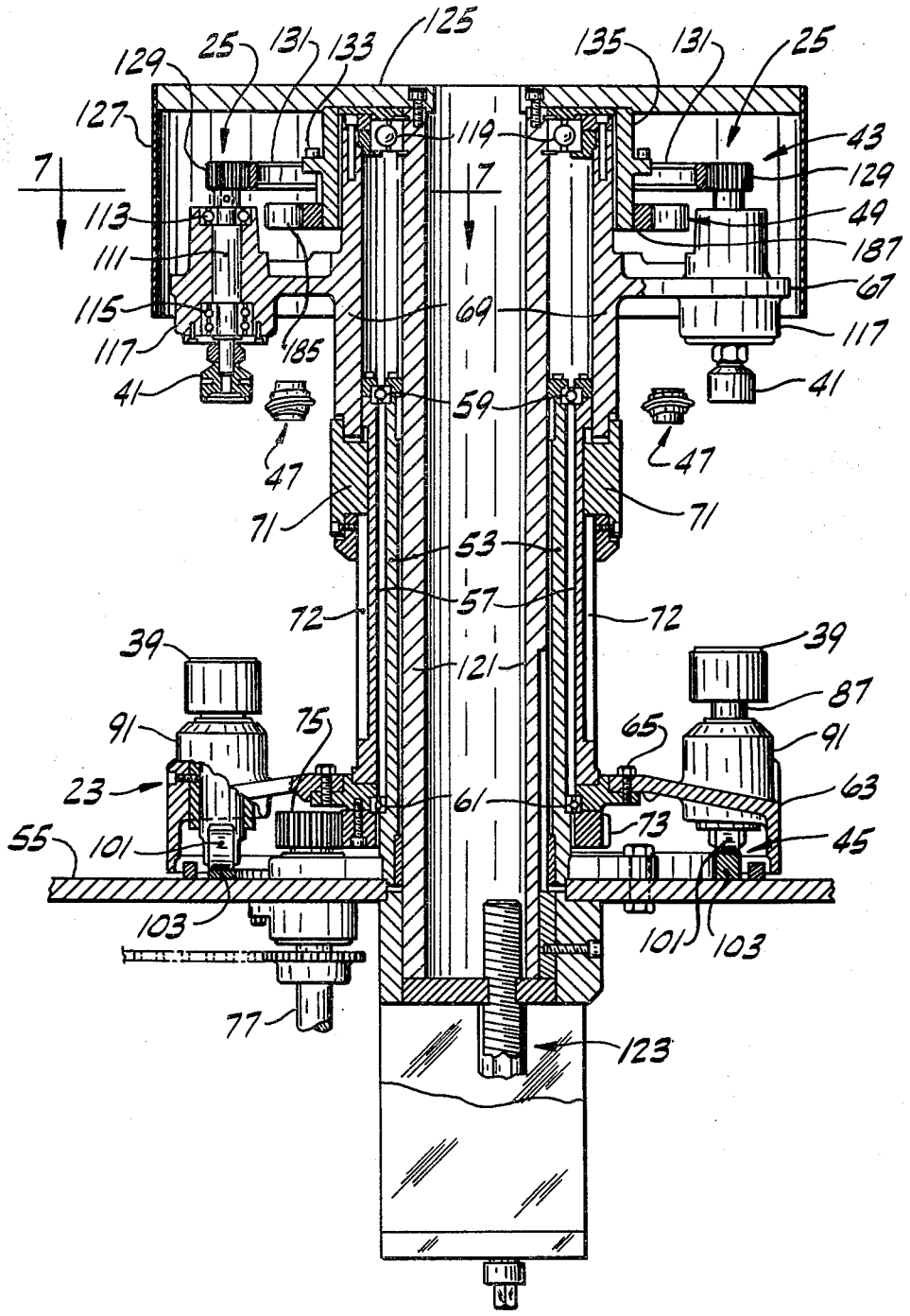
FIG. 5 is a vertical section of a turret of the apparatus, on a larger scale than FIGS. 1–3.

Each set of grippers 25 comprises a bottom gripper 39 and a top gripper 41 adapted to grip a container in upright position therebetween (see FIGS. 3 and 5). These grippers 39 and 41 are relatively movable on the conveyor means 23 between an open position, wherein they are separated a distance greater than the height of a container, for delivery of a container with a cap thereon on to the bottom gripper 39, and a closed position for gripping the container with the cap thereon. They are also rotatable relative to the conveyor means, as will appear, and means indicated generally at 43 is provided for rotating the top grippers 41 as the conveyor means 23 carries the sets of grippers 25 through their endless path of movement for rotating the containers and the caps thereon. Means indicated generally at 45 is provided for effecting closing movement of the bottom and top grippers 39 and 41 of each set 25 as the set travels away from the loading station 27, for holding them closed as the set travels through the crimping zone 29, and for opening them as they travel out of the crimping zone to the unloading station 31.

The conveyor means 23 further carries a series of cap crimping tools, one for each container holder 25, each of these tools being designated 47. There being eight sets 25 of grippers 39 and 41, there are eight crimping tools 47, spaced at 45° intervals around the conveyor means. Each of the crimping tools is mounted on the conveyor means for movement from a retracted position spaced from a cap on the container 5 held in the respective set 25 of grippers (i.e., gripped between members 39 and 41 of the set) to a crimping position in crimping engagement with the lower margin of the skirt 13 of the cap 3 under the flange of the container. At 49 is indicated means for moving each crimping tool 47 to its crimping position as the respective set 25 of grippers moves away from the loading station 27, for holding it in its crimping position for crimping the cap 3 on the container 5 as the container travels through the crimping zone 29, and then retracting it, whereupon the container is unloaded from the conveyor means 23 at the unloading station 31 by unloading means 51 (see FIGS. 1, 15 and 16). To be specific, the endless conveyor means 23 is a rotary turret rotatable on the vertical axis of a hollow cylindrical column 53 (see FIG. 5) extending up from a table 55. The conveyor means or turret 23 comprises a quill 57 journalled for rotation by means of bearings 59 and 61 on the column, a lower wheel 63 secured to the quill as indicated at 65, and an upper wheel or head 67 having a central hub 69 mounted for vertical sliding movement on the quill and extending up above the upper end of the quill. The hub 69 carries keys 71 which are slidable in vertical grooves 72 in the quill for keying the head 67 to the quill 57 for rotation thereof. The aforesaid means 33 for continuously driving the conveyor means or turret 23 comprises a ring gear 73 secured to the bottom of the lower wheel 63 with a pinion 75 in mesh with the ring gear, the pinion being on the upper end of a vertical shaft 77 extending up through an opening in the table 55 from the output shaft of a speed-reducing gear box 79, the input of which is driven by an electric motor 81 via a belt and pulley drive 83 (see FIGS. 2, 3 and 5).

Figure 6:
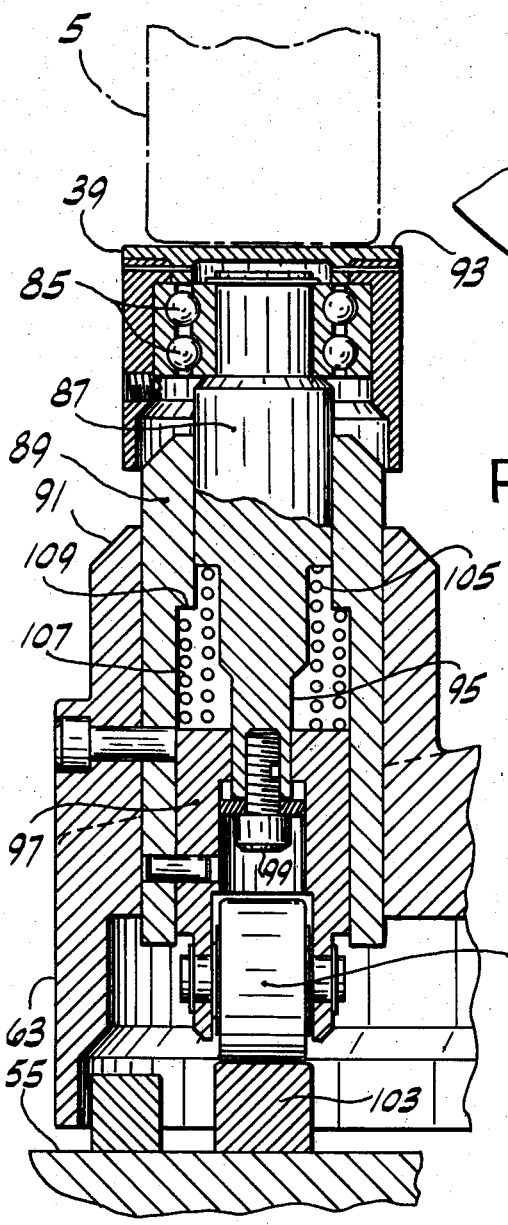
FIG. 6 is an enlarged vertical section of one of the bottom grippers of certain sets of grippers of the turret.
Figure 7:
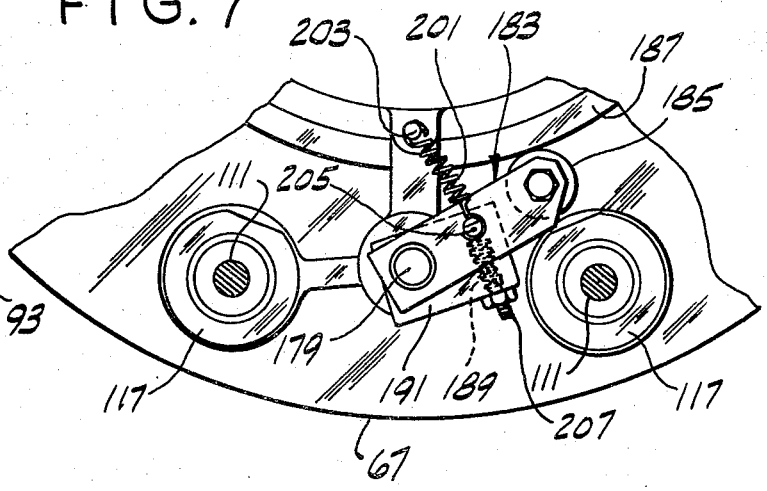
FIG. 7 is an enlarged section on line 7—7 of FIG. 5 showing details of one of a series of cap crimping means of the apparatus.
Figure 8:
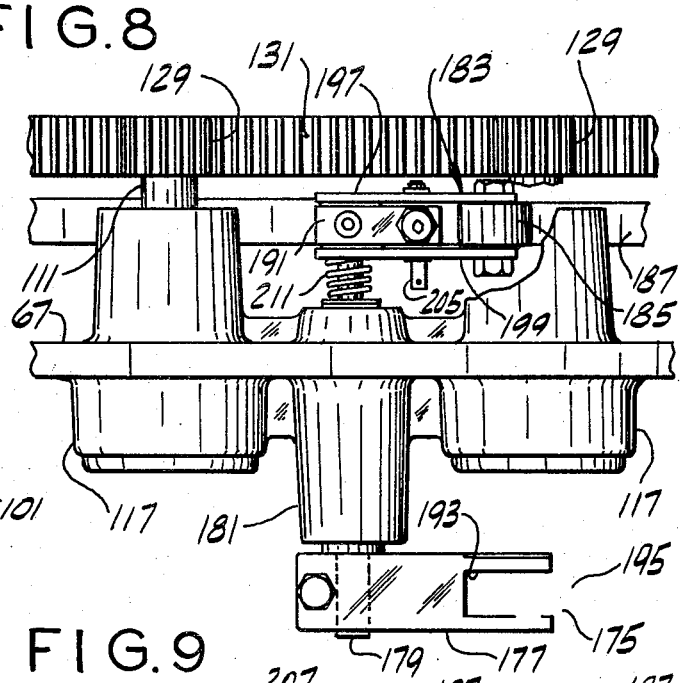
FIG. 8 is a view in elevation of the crimping means shown in FIG. 7.
Figure 9:
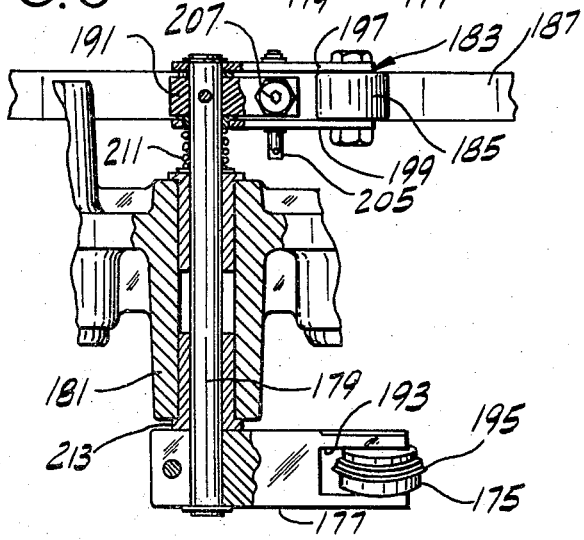
FIG. 9 is a view similar to FIG. 8 with parts broken away and parts shown in section.
Figure 10:
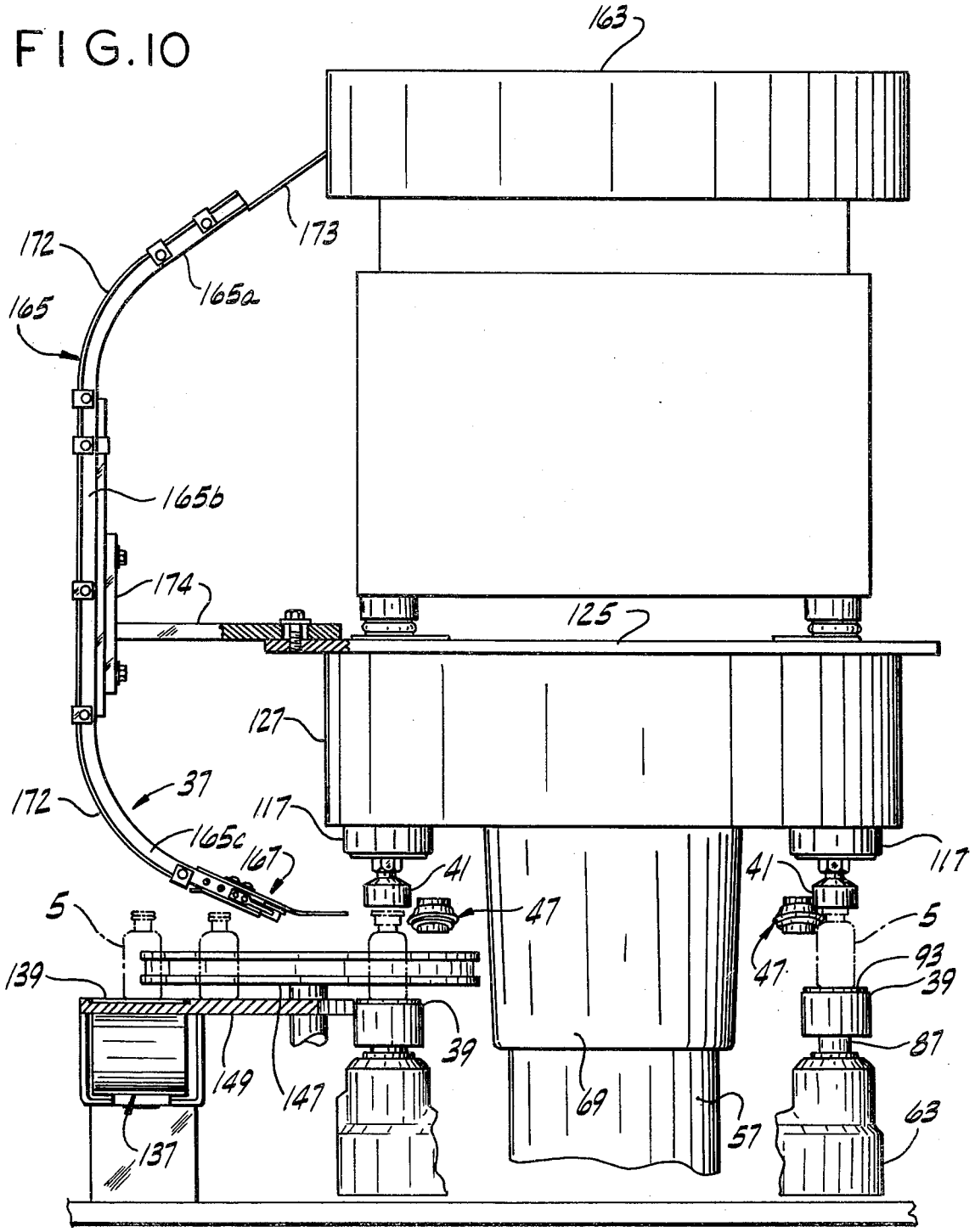
FIG. 10 is a view in elevation and with parts broken away and shown in section, showing a chute of the apparatus for feeding caps to the containers and certain means for delivering containers with caps thereon to the turret.

The lower wheel 63 carries the bottom grippers 39 of the sets 25 of grippers. There are eight sets 25, and hence eight bottom grippers 39, spaced at 45° intervals around the wheel. Each bottom gripper 39 (see FIG. 6, particularly) comprises a head adapted to support a container, the head being mounted for free-spinning rotation as by means of ball bearings 85 on the upper end of a rod 87 vertically slidable in a sleeve 89 set in a hollow cylindrical boss formation 91 of the wheel 63. There are eight such bosses 91 spaced at 45° intervals around the wheel. The head has a flat horizontal upper surface 93 over which the bottom of a container may readily slide. Provision may be made for mounting heads of different diameters at the upper end of the rod for handling different sizes of containers. The rod 87 has a reduced-diameter lower end extension 95 which extends down into a plunger 97 slidable in the sleeve 89, with a lost-motion connection at 99 between the lower end of the rod and the upper end of the plunger. The plunger has a cam follower roller 101 at its lower end which rides on a circular lifter cam 103 mounted on the table 55 surrounding the base of the column 53. A coil compression spring 105 is interposed between the rod 87 and the plunger 97 tending to separate them to the limit of the lost-motion connection 99, and a coil compression spring 107 is interposed between a shoulder 109 in the sleeve 89 and the upper end of the plunger 97 for biasing the plunger downwardly for engagement of the cam follower roller 101 with the cam 103. The cam is developed and phased to effect lift of each of the eight bottom grippers 39 for raising the container 5 thereon as the gripper 39 moves away from the loading station 27, to hold it raised throughout the crimping zone 29 and then to lower the gripper 39 to lower the container.

The upper wheel or head 67 of the turret 23 carries the top grippers 41, each of which is adapted to grip the mouth end of a stoppered container or vial 5 with a cap 3 thereon, there being eight such top grippers 41 spaced at 45° intervals around the head 67, one for each bottom gripper 39, each being directly above and coaxial with the respective bottom gripper. Each top gripper comprises a socket dimensioned to receive the cap 3 on the mouth end of a container 5, the socket being removably secured on the lower end of a shaft 111 journalled for rotation on a vertical axis (the same axis as that of the respective bottom gripper 39) in bearings 113 and 115 in a hollow cylindrical boss formation 117 of the head. There are eight such bosses 117 spaced at 45° intervals around the head. The top grippers or sockets 41 are removable and replaceable with sockets of different sizes for handling containers with different flange 9 diameters (and the corresponding caps). The hub 69 of the wheel or head 67, extending up above the upper end of the fixed column 53, is journalled by means of a bearing 119 for rotation at its upper end around a hollow cylindrical center stem or post 121 mounted for vertical sliding movement in the fixed column 53. This post is vertically adjustable in the column 53 by means of a screw adjustment mechanism such as indicated at 123 for adjusting the turret head 67 to different elevations relative to the turret bottom wheel 63. A cover plate 125 is secured on the upper end of the adjustable post 121, an annular skirt 127 being provided extending down from the rim of the plate 125 enclosing the head 67. Each top gripper shaft 111 has a pinion 129 secured on its upper end in mesh with a ring gear 131 secured as indicated at 133 on a hub 135 which extends down from the cover plate 125 surrounding the upper end of the hub 69. The gear hub 135 is secured to the cover plate so that it and the gear 131 are non-rotatable, while being movable up and down for the turret head adjustment. The arrangement is such that the turret 23, comprising the quill 57, the lower wheel 63 and the upper wheel or head 67, is continuously rotatable about the vertical axis of the fixed center column 53 to carry the sets 25 of grippers, each comprising a bottom gripper 39 for supporting a container 5 in upright position thereon, and a top gripper 41 for gripping the mouth end of the container standing on the bottom gripper, and a cap 3 on the mouth end of the container, around in a circular path centered in said vertical axis. As the turret 23 rotates, the bottom grippers are raised for the chucking of the mouth ends of the containers and the caps thereon in the sockets 41, and subsequently lowered for releasing the containers. Also, the top grippers or sockets 41 are continuously rotated via the intermeshing engagement of the pinions 129 on the shafts 111 with the fixed ring gear 131. The turret head 67 which carries the top grippers 41 is vertically adjustable, via the raising and lowering of the center stem or post 121, for handling containers of different heights.

The means 35 for delivering a container 5 to a set 25 of grippers of the turret 23 as the set travels in its circular path through the loading station 27 comprises an endless belt conveyor 137 having an upper reach 139 adapted to carry containers standing in upright position thereon in the direction from left to right as shown in FIG. 1. This conveyor 137 extends over the table 55 from left to right as viewed in FIG. 1, its length being considerably greater than the width of the table so that it projects left and right from the table. It serves both to carry containers 5 toward the table for delivery to the turret 23 and to carry containers away from the turret and the table. The upper reach 139 of the conveyor is located at the same level as the lowered level of the upper flat faces 93 of the bottom grippers 39. Stoppered containers 5 ready for capping are placed on the upper reach 139 of the conveyor 137 toward its left end, which is its infeed end, and are fed thereby to a timing screw 141, being confined as they travel along with the upper reach of the conveyor between side guides 143.

Figure 15:
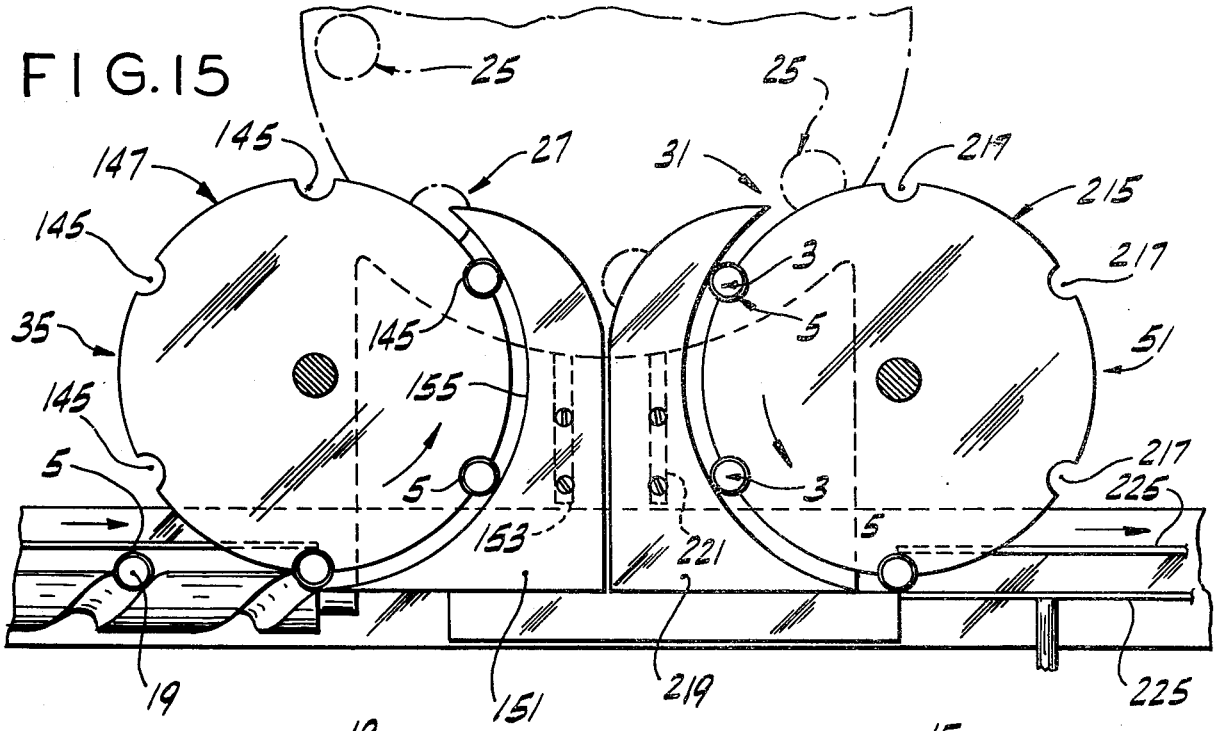
FIG. 15 is an enlarged plan showing details of the means for delivering containers to the turret, and a means for unloading containers from the turret.
Figure 16:
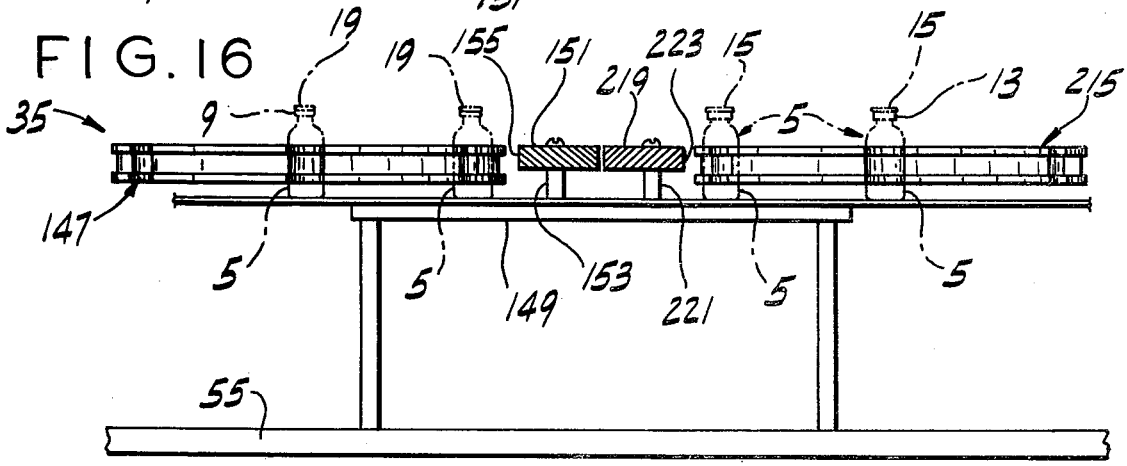
FIG. 16 is a view in elevation, with parts shown in section, of FIG. 15.
Figure 17:
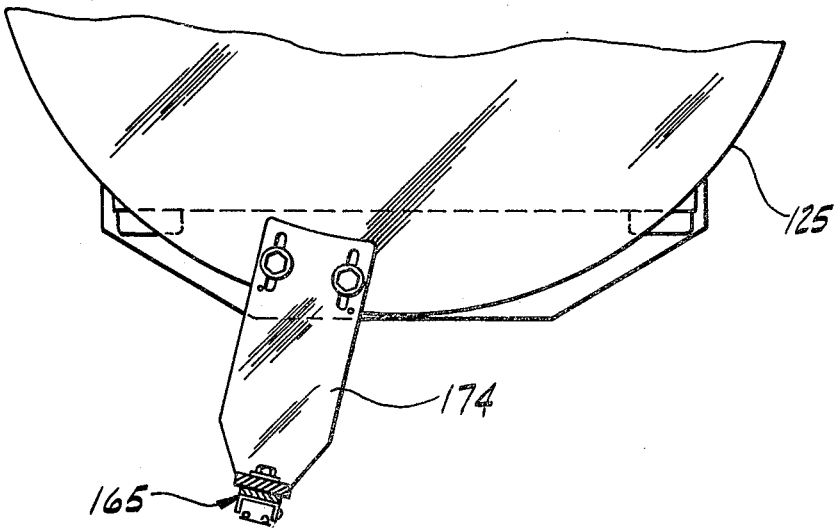
FIG. 17 is an enlarged plan showing the mounting for the cap chute.

The timing screw 141, which is of conventional configuration, accelerates the containers 5, sliding them along the upper reach 139 of the conveyor 137 faster than the speed of the upper reach, and delivers them one after another to the notches 145 of a container infeed star wheel 147. As shown in FIGS. 1 and 15, there are six such notches in the periphery of the star wheel spaced at 60° intervals, each adapted to receive a container 5 and carry it around in a circular path having its center in the star wheel axis. The timing screw 141 and the star wheel 147 are located at a level above the level of the upper reach 139 of the conveyor 137, and the star wheel extends over the lower wheel 63 of the turret 23 at a level above the lowered level of the upper faces 93 of bottom grippers 39 so that the star wheel is adapted to move a container on to a bottom gripper 39 at the latter, in its lowered position, travels through the loading station 27. The star wheel level is also high enough to enable the bottom gripper 39 to rise and lift the container thereon for engagement of the mouth end of the container and the cap 3 thereon in the respective top gripper or socket 41. The container, gripped between the bottom and top grippers, then leaves the star wheel 147 and travels around with and in the turret 23 through the crimping zone 29. In being fed by the star wheel 147 from the timing screw 141 to the turret 23, the container slides over a platform 149 (see FIGS. 10, 15 and 16) at a level above the top of table 55 corresponding to the lowered level of the bottom grippers 39, being confined in the notch 145 in the star wheel by a guide 151 mounted on a block 153 on the platform having a curved guide edge 155 following and spaced from the periphery of the star wheel.

The conveyor 137 is continuously driven by suitable drive means such as indicated at 157. The star wheel 147 is continuously driven in timed relation to the turret 23 by a chain and sprocket drive 159 taken off the vertical turret-driving shaft 77. The timing screw 141 is driven in timed relation to the star wheel 147 by a drive 161 taken off the star wheel drive 159.

The means 37 for placing a cap 3 on the mouth ends of the containers 5 prior to the delivery of the containers to the sets 25 of grippers on the turret 23 comprises a vibratory bowl 163 mounted on the turret cover plate for holding a supply of caps 3, and a chute 165 for delivering the caps from the bowl to the mouth ends of containers 5 as they are delivered by the infeed star wheel 147 to the turret. The vibratory bowl is a conventional commercially available item, such as the vibratory bowl sold by Industrial Feedings Systems Inc. of Indianapolis, Indiana. It automatically supplies caps to the cap shute 165, the caps travelling down in the chute from the bowl to the lower end 167 of the chute where the lowermost cap comes into a pick-off position inclined off horizontal with its top up and skirt extending down, as shown in FIG. 13, against a pair of spring fingers 169. The lowermost cap, in said pick-off position, is adapted for engagement of the mouth end of a container 5 being fed toward the turret by the infeed star wheel 147 with the inside of the lower part of the skirt 13 of the angled cap, so that the bottle pushes the cap out of the lower end of chute 165, the spring fingers 169 yielding for this purpose, the cap being pushed down on the mouth end of the bottle by a leaf spring 171 extending forward from the lower end of the chute. The chute comprises a channel provided with wires 172 extending along its open side. The channel is bent as appears in FIG. 10 to have an upper section **165*a* inclined downwardly away from the bowl 163, an intermediate vertical section 165*b* and a lower section 165*c* inclined downwardly toward the path of the containers. It is mounted on a bracket 174 secured to the cover plate 125. Caps travel out of the bowl down a ramp 173 to the upper end of the chute. The caps are delivered from the bowl with their tops 11 down; thus at the lower end of the chute, each cap is positioned with its top 11** up.

Each of the cap crimping tools 47 comprises a crimping roller 175 at the end of a tool arm 177 which extends radially from a rock shaft 179 journalled for rotation on a vertical axis in a hollow cylindrical boss formation 181 of the turret head 67. There are eight such bosses 181 spaced at 45° intervals around the head, each adjacent a boss 117. A cam follower arm 183 pivoted on the upper end of the rock shaft carries a cam follower roller 185 which engages an annular crimping cam 187 secured to the lower end of the gear hub 135 surrounding the hub 69. Arm 183 acts via a coil compression spring 189 on a crank 191 secured to the upper end of the rock shaft 179. The crimping roller 175 is mounted for free-spinning rotation in a slot 193 at the free end of the tool arm on an axis which is skewed off vertical, and has a peripheral rim 195 for engagement with the lower margin of the skirt 13 of a cap 3 for crimping it under the flange 9 of a container 5. The cam follower arm 183 is a two-part arm, comprising an upper part 197 above the crank 191 and a lower part 199 below the crank. A tension spring 201 connected at 203 to the turret head 23 and to a pin 205 extending between parts 197 and 199 of arm 183 swings arm 183 toward the crimping cam 187 for engagement of the cam follower roller 185 with the cam 187. The compression spring 189 is interposed between an adjustment screw 207 threaded in a tapped hole in the crank 191 and a spring abutment on the pin 205, the screw being adjustable to vary the force of spring 189. The shaft 179, in addition to being rotatable in the boss 181, is also vertically slidable in the boss and is biased upward by a coil compression spring 211 to the point where the tool arm 177 engages the bottom of a bearing bushing 213 for the shaft, this bushing being press-fitted in the boss.

The crimping cam 187 is developed and phased for moving the crimping roller 175 from a retracted position clear of the path of the mouth ends of containers 5 travelling around with the turret 23 to a crimping position wherein the crimping roller engages the cap 3 of a container which is gripped in the respective set 25 of grippers and spinning on its own axis as it travels around, the roller 175 moving to its crimping position as the set 25 of grippers leaves the loading station 27. Then, the cam 187 holds the crimping roller 175 in spring-pressurized crimping engagement with the lower margin of the skirt 13 of the cap as the container with the cap thereon travels around with the turret 23 through the crimping zone 29. Then the cam 187 effects retraction of the crimping roller 175 for the unloading of the container at the unloading station 31. The compression spring 189, which is interposed between arm 183 and the crank 191, effects the spring-pressurization of the crimping roller against the skirt of the cap.

The unloading means 51 comprises an outfeed star wheel 215 having six notches 217 similar to the infeed star wheel 147. This outfeed star wheel extends over the lower wheel 63 of the turret at the same level as the infeed star wheel 147 and is adapted to move a container off a bottom gripper 39 as the latter, in its lowered position, travels through the unloading station 31. The container is received in one of the notches 217 in the outfeed star wheel 215 while the container is still gripped between the bottom gripper 39 (in its raised position) and the top gripper 41 of the respective set. Then, the bottom gripper 39 is lowered to release the container, and the outfeed star wheel 215 slides the container off the bottom gripper and over the platform 149 on to the upper reach 139 of the conveyor 137, which takes the container away. The container is confined while in transit to the conveyor 137 in the notch 217 of the outfeed star wheel 215 by a guide 219 similar to guide 151 mounted on a block 221 having a curved guide edge 223. The outfeed star wheel 215 is continuously driven in timed relation to the turret 23 by the chain and sprocket drive 159. Side guides for containers travelling away from the outfeed star wheel are indicated at 225 in FIG. 1.

Operation is as follows:

The turret 23 is continuously driven in clockwise direction as viewed from above (and as viewed in FIG. 1). The infeed and outfeed star wheels 147 and 215 are continuously driven in the directions indicated by the arrows in FIGS. 1 and 15 in timed relation to the turret 23, and the timing screw 141 is driven in timed relation to the infeed star wheel. The conveyor 137 is continuously driven at a speed appropriate for delivery of containers 5 to the timing screw 141 and for delivery of containers 5 away from the outfeed star wheel 215.

Containers 5 which have been filled and plugged by the rubber stoppers 19 are placed in upright position standing on the upper reach 139 of the conveyor 137, and are carried thereby one after another to the timing screw 141. As each container reaches the timing screw, it is received in the groove of the screw and fed forward by the screw, being accelerated by the latter. Linear velocity of the star wheel is greater than the timing screw—(enabling reduction in the conveyor speed). In being so accelerated, it slides over the upper reach 139 of the conveyor 137. The timing screw is so phased in relation to the notches 145 in the infeed star wheel 147 as to deliver each successive container to a notch 145 as the notch comes around to the exit end of the groove in the screw (its right end as viewed in FIGS. 1 and 2).

Upon the delivery of a container 5 by the timing screw 141 to a notch 145 in the infeed star wheel 147, the latter sweeps the container away from the screw, sliding the container over the platform 149 in the circular path of the notches of the wheel 147. As the container proceeds along this path, its mouth end engages the skirt 13 of a cap 3 at the lower end 167 of chute 165 (see FIG. 13), and pushes the cap out of the lower end of the chute, with resultant application of the cap to the mouth end of the container over the stopper 19. The wheel 147 then delivers the container onto the bottom gripper 39 of one of the sets 25 of grippers as this gripper 39 travels through the loading station 27 in its lowered position at the level of platform 149. The gripper 39 remains at this level until the container is moved onto the gripper 39 by the infeed star wheel 147; then, as the gripper 39 proceeds farther through the loading station with the container thereon, it is raised by the cam 103 to raise the container 5 for chucking the mouth end of the container with the cap 3 thereon in the respective top gripper or socket 41. Here it will be observed that the level of the top grippers 41 is adjusted, in accordance with the height of containers being capped, by vertical adjustment of the turret head 67 by means of the screw mechanism 123, to the point where containers 5 may be slid onto the bottom grippers (in their lowered position) with the upper ends of the containers below the level of the top grippers 41, after which the bottom grippers 39 may be raised for chucking the mouth ends of the containers with the caps thereon in the top grippers 41.

The container 5, gripped between the raised bottom gripper 39 and the top gripper 41, is carried out of the notch 145 of the infeed star wheel 147 and travels around in the circular path of travel of the sets 25 of grippers through the crimping zone 29, which as shown in FIG. 1 extends for about 270° of arc around said circular path from the loading station 27 to the unloading station 31. The top gripper 41 is continuously rotated on its axis by the engagement of the pinion 129 on the upper end of the top gripper shaft 111 with the non-rotatable ring gear 131. The pressure of the grippers 39 and 41 on the container and the cap 3 on the container is sufficient to cause the top gripper 41 to rotate the container and the cap 3 thereon on the vertical axis of the container (which coincides with the vertical axis of the grippers 39 and 41) as the container travels through the crimping zone.

The container 5, in being raised by the bottom gripper 39 to chuck its upper end with the cap 3 thereon in the top gripper or socket 41, is brought to a position in which the lower margin of the skirt 13 of the cap 3, which extends down below the flange 9 of the container at the mouth end of the container, is generally at the level of the adjacent part or the peripheral rim 195 of the respective crimping roller 175. As the container 5 enters the crimping zone, the tool arm 177 carrying the roller 175 is swung to bring the rim 195 of the roller 175 into pressurized engagement with the lower margin of the skirt of the cap and to maintain this engagement throughout the crimping zone so that the lower margin of the cap is crimped under the flange 9 of the container. The lower margin of the skirt of the cap is crimped in under the flange of the container by the rim 195 of the roller 175 as the cap rotates with the container, the roller 175 spinning freely on its axis in the process. As the container approaches the end of the crimping zone, the cam 187 effects retraction of the crimping roller 175.

As the container 5, travelling around with the turret 23, exits from the crimping zone 29 and enters the unloading station 31, the cam follower roller 101 for the bottom gripper 39 travels down a fall of the cam 103 and, under the bias of spring 107 the bottom gripper is lowered to lower the container 5. The mouth end of the container, with the cap 3 crimped thereon, comes down out of the top gripper or socket 41. The container is received in a notch 217 of the outfeed star wheel 215 and the latter sweeps the container off the bottom gripper 39 and slides it over the platform 149 to the upper reach 139 of conveyor 137, which carries it away.

As to each set 25 of grippers 39 and 41, the plunger 97 having the lost-motion connection at 99 with the rod 87 and the compression spring 105 interposed between the plunger and the rod constitutes means for causing the grippers resiliently to grip a container 5 enabling yielding of the grippers relative to one another, more particularly yielding of the bottom gripper, to compensate in the gripping for tolerance variations in the height of containers 5. Thus, as the cam 103 acts on the cam follower roller 101 at the lower end of a plunger 97 to push the plunger upwardly for gripping a container, the plunger 97 acts through the spring 105 to raise the bottom gripper 39, the container being thereby maintained in raised position with the cap 3 on the mouth end of the container in the top gripper or socket 41 by the force of the spring 105 (against the downward return bias of spring 107 on the plunger). With this arrangement, and with the top grippers or sockets 41 set at the proper level for a run of containers of a particular height subject to variations within tolerance, the containers are properly positioned for crimping of the caps despite tolerance variations in the height of the containers.

As to each crimping roller 175, the means comprising the respective arm 183, crank 191 and spring means 189 interposed between the arm and the crank constitutes means for causing the crimping roller resiliently to press inwardly on the skirt 13 of a cap 3 enabling yielding of the crimping roller radially relative to the cap to compensate for tolerance variations in the diameter of the skirts of the caps and the necks of the containers.

Also, as to each crimping roller 175, the means comprising the respective rock shaft 179 mounted for downward movement in boss 181 relative to a cap 3 and the spring means 211 resiliently biasing the shaft and hence the roller 175 upwardly enables downward yielding of the crimping roller to compensate for tolerance variations in the thickness of the flanges 9 of the containers.

With the crimping roller 175 mounted in the roller holder 177 with the axis of the roller skewed as illustrated relative to the axis of container 5, the skirt 13 of a cap 3 is crimped up from its lower edge, rather than being crimped down toward its lower edge, and this avoids scoring or tearing of the cap.

With the positive spin of the containers and the caps thereon, the crimping of the caps as they spin with the containers, the free spinning of the crimping rollers, and the accommodation for tolerance variations in container height and in the caps and the crimping up from the lower edge of the skirt, the caps are crimped at a relatively high rate with more uniformly effective seals and with good appearance; and with the turret head 67 adjustable up and down, the apparatus is readily adapted to handle containers and caps of different sizes.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for applying caps to containers such as glass vials or bottles, the containers being of the type having a neck and a flange on the neck at the mouth end thereof, and the caps being of the type having an annular skirt adapted to surround the flange and to be crimped under the flange, said apparatus comprising:

endless conveyor means;

a series of sets of grippers carried by the conveyor means spaced at equal intervals therearound, each set being adapted to grip a container at the top and bottom of the container;

said conveyor means being movable to move the sets of grippers through an endless generally horizontal path with containers held in an upright position, and to carry each set of grippers from a loading station where a container with a cap thereon is delivered to the set through a crimping zone for crimping the cap and thence to an unloading station where the container is unloaded from the set;

means for continuously driving said conveyor means;

means for delivering a container to a set of grippers as the set travels through the loading station;

means for placing a cap on the mouth end of each container prior to its delivery to a set of grippers;

each set of grippers comprising a bottom and a top gripper adapted to grip a container in upright position therebetween, said bottom and top grippers being relatively movable on said endless conveyor means between an open position for delivery of a container with a cap thereon on to the lower gripper and a closed position for gripping the container with the cap thereon, and also being rotatable relative to the conveyor means;

means for continuously rotating the top grippers as the conveyor means carries the sets of grippers through said endless path for rotating the containers and the caps thereon;

means for effecting relative movement to closed position of the bottom and top grippers of each set of grippers as the set travels away from the loading station, for holding them closed as they travel through said crimping zone, and for effecting relative movement to open position of the bottom and top grippers of each set as the set travels out of the crimping zone to the unloading station, a series of cap crimping tools, one for each set of grippers, carried by the conveyor means;

each of said crimping tools being mounted on the conveyor means for movement from a retracted position spaced from a cap on the container gripped in the respective set of grippers to a crimping position in crimping engagement with the skirt of the cap for crimping the skirt under the flange of the container;

means for moving each crimping tool to its crimping position as the respective set of grippers moves from the loading station into the crimping zone, holding the tool in crimping position for crimping the cap on the container as the container travels through the crimping zone and then retracting it;

and means for unloading containers from the sets of grippers at the unloading station.

2. Apparatus as set forth in claim 1 wherein, as to each set of grippers, the bottom gripper comprises a bottom support for a container and the top gripper comprises a socket for receiving the mouth end of the container with the cap thereon.

3. Apparatus as set forth in claim 1 wherein, as to each set of grippers, means is provided for causing the grippers resiliently to grip a container enabling yielding of the grippers relative to one another to compensate in the gripping for tolerance variances in the height of containers.

4. Apparatus as set forth in claim 1 wherein each crimping tool comprises a crimping roller engageable with the skirt of the cap, a roller holder carrying the crimping roller with the roller freely rotatable on its axis relative to the roller holder, and means mounting the roller holder on the conveyor means for movement to move the roller from retracted position to crimping position.

5. Apparatus as set forth in claim 4 wherein means is provided for causing the crimping roller resiliently to press inwardly on the skirt of a cap enabling yielding of the roller radially relative to the cap to compensate for tolerance variations in the diameter of the skirts of the caps and the necks of the containers.

6. Apparatus as set forth in claim 5 wherein means is provided mounting the crimping roller for downward movement relative to a cap and resiliently biasing the roller upwardly enabling downward yielding of the roller to compensate for tolerance variations in the thickness of the flange of the containers.

7. Apparatus as set forth in claim 4 wherein the crimping roller is mounted in the roller holder with the axis of the roller skewed relative to the container axis for crimping the skirt up from its lower edge.

8. Apparatus as set forth in claim 3 wherein each crimping tool comprises a crimping roller engageable with the skirt of the cap, a roller holder carrying the crimping roller with the roller freely rotatable on its axis relative to the roller holder, and means mounting the roller holder on the conveyor means for movement to move the roller from retracted position to crimping position, wherein means is provided for causing the crimping roller resiliently to press inwardly on the skirt of a cap enabling yielding of the roller radially relative to the cap to compensate for tolerance variations in the diameter of the skirts of the caps, and the necks of the containers, and wherein means is provided mounting the crimping roller for downward movement relative to a cap and resiliently biasing the roller upwardly enabling downward yielding of the roller to compensate for tolerance variations in the thickness of the flange of the containers.

9. Apparatus as set forth in claim 8 wherein the crimping roller is mounted in the roller holder with the axis of the roller skewed relative to the container axis for crimping the skirt up from its lower edge.

10. Apparatus as set forth in claim 1 wherein said endless conveyor means comprises a rotary turret having a lower wheel and an upper head, and each of the bottom grippers comprises a bottom support for a container, the top grippers being carried by the head at a fixed elevation relative to the head, said means for effecting relative movement to closed position of the bottom and top grippers comprising means mounting each support for vertical movement relative to the lower wheel between a lowered retracted position for having a container slid onto the support and subsequently slid off the support and a raised position for engagement with the respective top gripper of the mouth end of the container with a cap thereon, and means for raising the support as it travels away from the loading station, holding it raised as it travels through the crimping zone, and lowering the support as it travels out of the crimping zone to the unloading station, and wherein the crimping tools are carried by the turret head.

11. Apparatus as set forth in claim 10 wherein the turret head is vertically adjustable for capping containers of different heights.

12. Apparatus as set forth in claim 10 wherein the means for raising the bottom supports comprises a fixed cam ring surrounding the turret axis, the supports having cam follower rollers rolling around on the ring.

13. Apparatus as set forth in claim 10 wherein the top grippers are at the lower ends of vertical shafts journalled in the turret head, and the means for continuously rotating the top grippers comprises a pinion on each top gripper shaft and a gear fixed to the head surrounding the turret axis, the pinions being in mesh with said gear.

14. Apparatus as set forth in claim 10 wherein means is provided for causing the bottom supports resiliently to grip a container enabling downward yielding of the supports to compensate in the gripping for tolerance variations in the height of containers.

15. Apparatus as set forth in claim 14 wherein the means for raising the bottom supports comprises a fixed cam ring surrounding the turret axis, and cam follower rollers for the supports rolling around on the ring, said resilient grip means for each support comprising a member carrying the respective cam follower roller, and spring means interposed between said member and the support.

16. Apparatus as set forth in claim 10 wherein each crimping tool comprises a crimping roller engageable with the skirt of the cap, and a roller holder carrying the crimping roller with the roller freely rotatable on its axis relative to the roller holder, and means mounting the roller holder on the turret head for movement to move the roller from retracted to crimping position.

17. Apparatus as set forth in claim 16 wherein the means for moving the crimping tools to their crimping position comprises a crimping cam surrounding the turret axis fixed against rotation about the turret axis and crimping cam follower rollers for the crimping roller holders engaging said crimping cam.

18. Apparatus as set forth in claim 17 wherein means is provided for causing the crimping rollers resiliently to press inwardly on the skirt of a cap enabling yielding of the crimping rollers radially relative to the caps to compensate for tolerance variations in the diameter of the skirts of the caps and the necks of the containers.

19. Apparatus as set forth in claim 18 wherein said resilient press means comprises spring means interposed between said crimping cam follower rollers and said crimping roller holders.

20. Apparatus as set forth in claim 19 wherein means is provided mounting the crimping roller holders for downward movement relative to the top grippers and resiliently biasing them upwardly enabling downward yielding of the crimping rollers to compensate for tolerance variations in the thickness of the flange of the containers.

21. Apparatus as set forth in claim 16 wherein each crimping roller is mounted in its holder with the axis of the roller skewed relative to the container axis for crimping the skirt up from its lower edge.

22. Apparatus as set forth in claim 14 wherein each crimping tool comprises a crimping roller engageable with the skirt of the cap, and a roller holder carrying the crimping roller with the roller freely rotatable on its axis relative to the roller holder, and means mounting the roller holder on the turret head for movement to move the roller from retracted to crimping position, wherein means is provided for causing the crimping rollers resiliently to press inwardly on the skirt of a cap enabling yielding of the crimping rollers radially relative to the caps to compensate for tolerance variations in the diameter of the skirts of the caps and the diameter of the necks of the containers, and wherein means is provided mounting the crimping roller holders for downward movement relative to the top grippers and resiliently biasing them upwardly enabling downward yielding of the crimping rollers to compensate for tolerance variations in the thickness of the flange of the containers.

23. Apparatus as set forth in claim 22 wherein the turret head is vertically adjustable for capping containers of different heights.

24. Apparatus as set forth in claim 23 wherein the means for raising the bottom supports comprises a fixed cam ring surrounding the turret axis, the supports having cam follower rollers rolling around on the ring.

25. Apparatus as set forth in claim 23 wherein the top grippers are at the lower ends of vertical shafts journalled in the turret head, and the means for continuously rotating the top grippers comprises a pinion on each top gripper shaft and a gear fixed to the head surrounding the turret axis, the pinions being in mesh with said gear.

26. Apparatus as set forth in claim 25 wherein the means for raising the bottom supports comprises a fixed cam ring surrounding the turret axis, and cam follower rollers for the supports rolling around on the ring, said resilient grip means for each support comprising a member carrying the respective cam follower roller, and spring means interposed between said member and the support.

27. Apparatus as set forth in claim 26 wherein the means for moving the crimping tools to their crimping position comprises a crimping cam surrounding the turret axis fixed against rotation about the turret axis and crimping cam follower rollers for the crimping roller holders engaging said crimping cam.

28. Apparatus as set forth in claim 27 wherein said resilient press means comprises spring means interposed between said crimping cam follower rollers and said crimping roller holders.

29. Apparatus as set forth in claim 28 wherein each crimping roller is mounted in its holder with the axis of the roller skewed relative to the container axis for crimping the skirt up from its lower edge.

* * * * *